US006036058A

United States Patent [19]

Chou

[11] Patent Number: 6,036,058

[45] Date of Patent: Mar. 14, 2000

[54] LIQUID SOAP DISPENSER

[76] Inventor: Chia Chou, 3F, No.3 Alley 9, Lane 81, Yeong Yeh Rd., Hsintien, Taipei, Hsien, Taiwan

[21] Appl. No.: 09/161,748

[22] Filed: Sep. 23, 1998

[51] Int. Cl.[7] ..... B65D 37/00

[52] U.S. Cl. ..... 222/214; 222/181.3

[58] Field of Search ..... 222/214, 181.3

[56] References Cited

U.S. PATENT DOCUMENTS 5,248,066 9/1993 Olson et al. ..... 222/214 X 5,265,772 11/1993 Bartasevich et al. ..... 222/214

*Primary Examiner*—Gregory L. Huson

*Attorney, Agent, or Firm*—Donald C. Casey, Esq.

[57] ABSTRACT

A liquid soap dispenser includes a housing, a container holder inside the housing to hold a liquid soap container, a flexible dispensing nozzle connected to the liquid soap container to such in a liquid soap from the liquid soap container, and a handle pivoted to the housing and turned to squeeze an amount of the liquid soap out of the flexible dispensing nozzle wherein the container holder is detachably fastened to a base frame of the housing by a hooked joint, the axis which passes through the center of rotation of the handle intersects with the longitudinal central axis of the flexible dispensing nozzle.

1 Claim, 5 Drawing Sheets

LIQUID SOAP DISPENSER

BACKGROUND OF THE INVENTION

The present invention relates to a liquid soap dispenser for use in a toilet, and more particularly to such a liquid soap dispenser which can be used with either of a set of different volumes of liquid soap containers.

FIG. 1 shows the outer appearance of a regular liquid soap dispenser for use in a toilet. The internal structure of the liquid soap dispenser is shown in FIG. 2. As illustrated, this structure of liquid soap dispenser comprises a base frame 7, a cover shell 1 covered on the base frame 7, a handle 2 extended out of the cover shell 1, a container holder 3, a liquid soap container 4, a dispensing nozzle 5 and a locking frame 6 mounted inside the holding space defined between the base frame 7 and the cover shell 1 to lock the cover shell 1. When the user depresses the handle 22, a liquid soap is squeezed out of the cover shell 1 for application. The cover shell 1 comprises two pivot holes 11 bilaterally disposed on the inside at the bottom, two bottom rods 12. and two pivot pins 13 respectively raised from the bottom rods 12. The handle 2 is disposed outside the cover shell 1, having two pivot pins 21 respectively pivoted to the pivot holes 11. The base frame 7 comprises two pivot holes 71 bilaterally disposed at the bottom and respectively pivoted to the pivot pins 13 of cover shell 1. Therefore, the cover shell I can be turned about the axis, which passes through the pivot holes 71, between a first position where the cover shell 1 is covered on the base frame 7, and a second position where the cover shell 1 is opened from the base frame 7. The base frame 7 comprises a plurality of hanging holes 72 for hanging on wall nails, a plurality of angled retaining rods 74 raised from the inside wall thereof, which hold the control member 6 inside the liquid soap dispenser and enable the control member 6 to be moved vertically upwards to unlock the cover shell 1, a plurality of raised portions 731 provided at the inside wall near the top, which limit the up stroke of the control member 6, a plurality of locating ribs 73 fitting the shape of the control member 6, a bottom flange 76, and two stop ribs 75 transversely aligned at the inside wall. The control member 6 comprises a plurality of horizontal bars 61 disposed at different elevations, a plurality of hooks 62 respectively raised from the ends of the horizontal bars 61 and hooked up with respective triangular projections 14 inside the cover shell 1, two spring elements 63 raised from the horizontal bars 61 and stopped at the stop ribs 75, two vertical bars 65 downwardly extended from the horizontal bars 61 on the middle, and a knob 64 integral with the vertical bars 65 at the bottom and suspending in a hole on the bottom flange 76 of the base frame 7. When the user pushes the knob 64 to lift the locking frame 6 and to disengage the hooks 62 from the triangular projections 14 for permitting the cover shell 1 to be opened from the base frame 7, the spring elements 63 are compressed. When the hand is released from the knob 64, the spring elements 63 immediately return to their former shape, causing the locking frame 6 to be pushed back to its former position. The container holder 3 is fixedly mounted on the inside wall of the base frame 7 above the bottom flange 76 to hold the liquid soap container 4, having vertically aligned front locating notches 31 for holding the dispensing nozzle 5. The liquid soap container 4 is carried on the container holder 3, and holds a liquid soap 41. The dispensing nozzle 5 comprises a flexible nozzle tube 53 having an inlet 51 at one end, which is connected to the liquid soap container 4 at the bottom to receive the liquid soap 41, and a nozzle tip 52 at an opposite end. When the user depresses the handle 2, the flexible nozzle tube 53 is squeezed to force a certain amount of the liquid soap 41 out of the nozzle tip 52. When the handle 2 is released from the flexible nozzle tube 53, the flexible nozzle tube 53 immediately returns to its former shape, and at the same time an equal amount of the liquid soap 41 is sucked into the flexible nozzle tube 53. Because the container holder 3 occupies much inside space of the liquid soap dispenser, the dimension of the liquid soap container 4 is limited, i.e., the liquid soap container 4 cannot be replaced with a different capacity of liquid soap container as desired.

SUMMARY OF THE INVENTION

The present invention has been accomplished to provide a liquid soap dispenser which eliminates the aforesaid drawback. It is one object of the present invention to provide a liquid soap dispenser which is practical for holding any of a variety of liquid soap containers. It is another object of the present invention to provide a liquid soap dispenser which can easily be operated with less labor. To achieve these and other objects of the present invention, there is provided a liquid soap dispenser comprised of a housing a container holder inside the housing to hold a liquid soap container, a flexible dispensing nozzle connected to the liquid soap container to such in a liquid soap from the liquid soap container, and a handle pivoted to the housing and turned to squeeze an amount of the liquid soap out of the flexible dispensing nozzle, wherein the container holder is detachably fastened to a base frame of the housing by a hooked joint, the axis which passes through the center of rotation of the handle intersects with the longitudinal central axis of the flexible dispensing nozzle.

DETAILED DESCRIPTION OF THE PREFERRED EMBODIMENT

Figure 1:
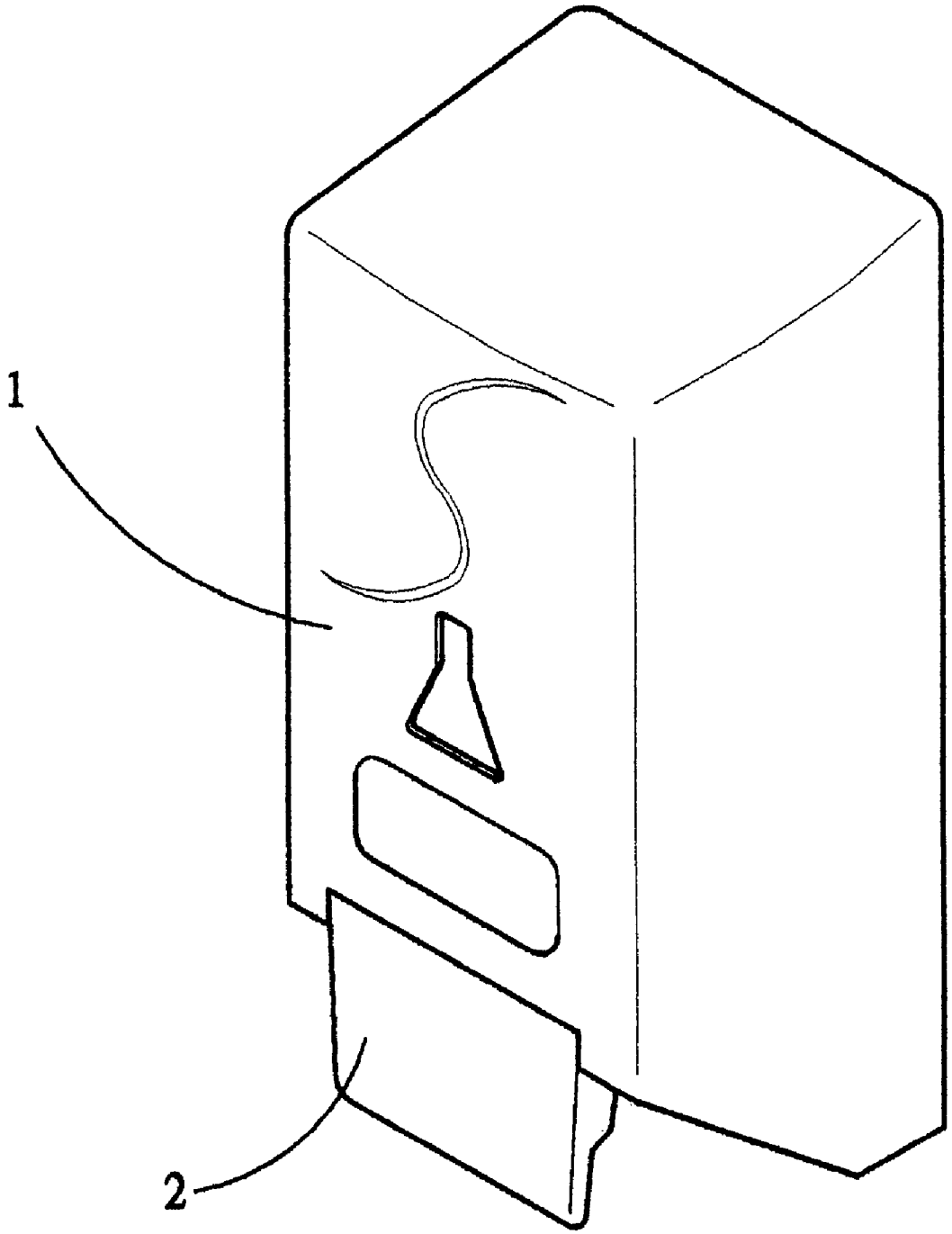
FIG. 1 (Prior Art)
FIG. 1 illustrates the outer appearance of a liquid soap dispenser according to the prior art.
Figure 2:
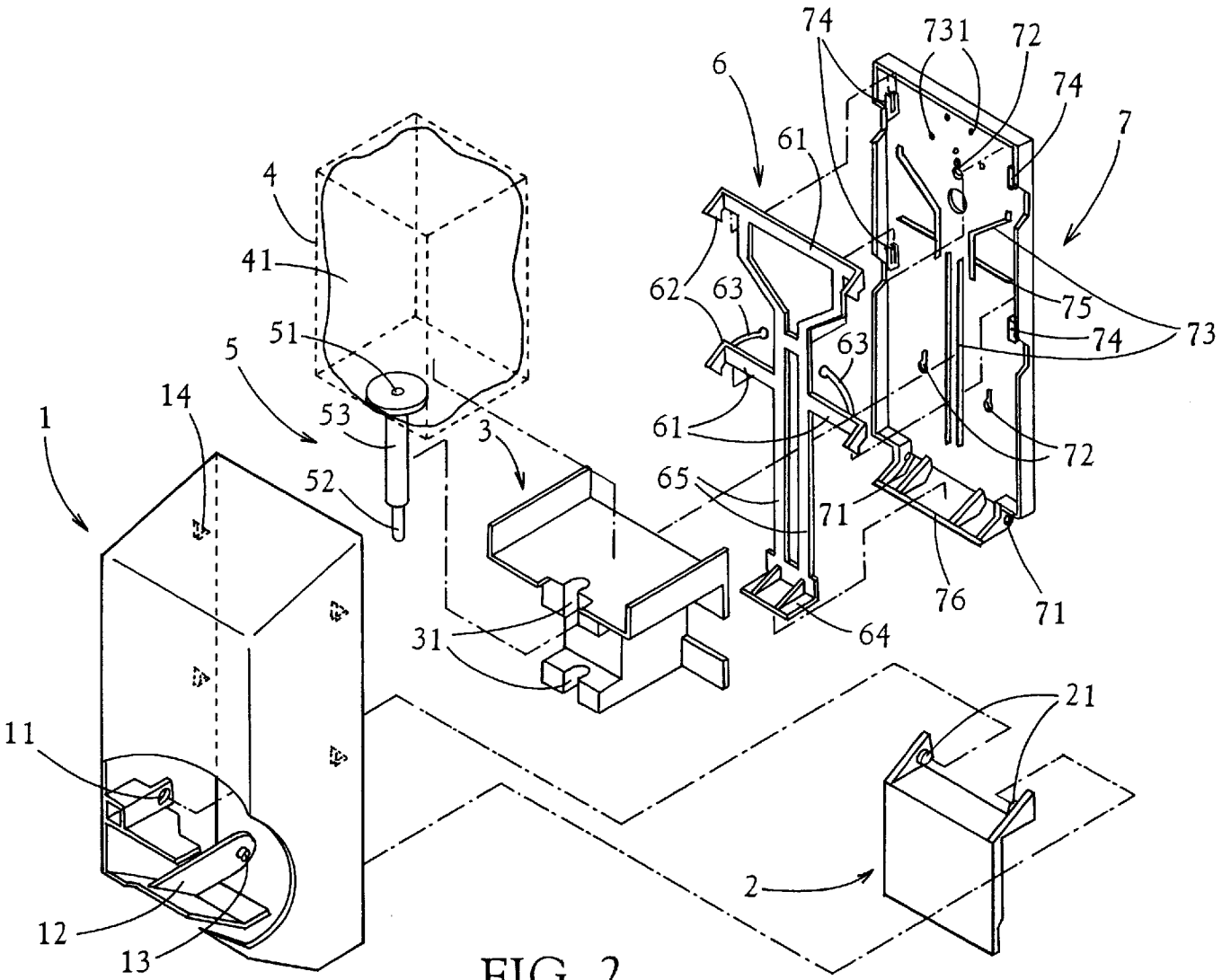
FIG. 2 (Prior Art)
FIG. 2 is an exploded view of the liquid soap dispenser shown in FIG. 1.
Figure 3:
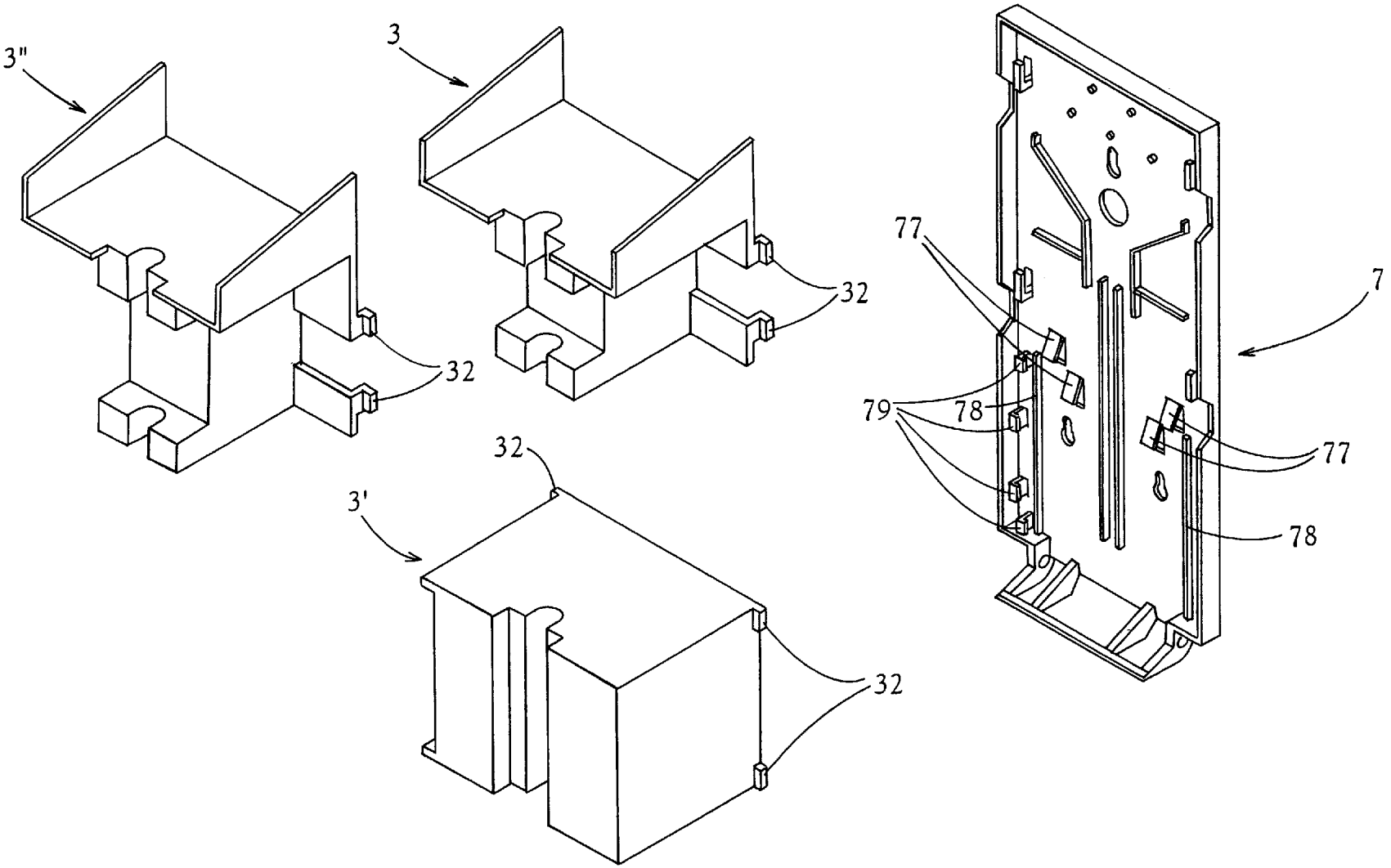
FIG. 3 shows different liquid soap holders used according to the present invention.

Referring to FIG. 3. the base frame 7 comprises two longitudinal flanges 78 raised from the inside wall and arranged in parallel, a plurality of spring strips 77 respectively raised from the inside wall between the longitudinal flanges 78, and two rows of vertically spaced hooks 79 bilaterally raised from the inside wall and separated by the longitudinal flanges 78. Different container holders 3,3',3" of different specifications are provided for fastening to the base frame 7 selectively. The container holders 3,3',3" each comprise symmetrical pairs of hooks 32 for hooking up with the hooks 79 at the base frame 7. When one container holder 3,3' or 3" is attached to the base frame 7, it is forced against the base frame 7 to compress the spring strips 77, enabling the hooks 32 of the container holder 3,3' or 3" to be hooked up with the hooks 79 at the base frame 7. When the hand is released from the container holder 3,3' or 3", the spring strips 77 impart an outward pressure to the container holder 3,3' or 3", thereby causing the hooks 32,79 to be firmly retained together. The container holders 3,3',3" include a first container holder 3 designed to hold 1000 cc liquid soap, a second container holder 3" designed to hold 800 cc liquid soap, and a third container holder 3' which comprises induction means for an automatic dispensing control and automatic squeezer means for squeezing out a metered amount of the contained liquid soap automatically each time the induction means is induced.

Figure 4:
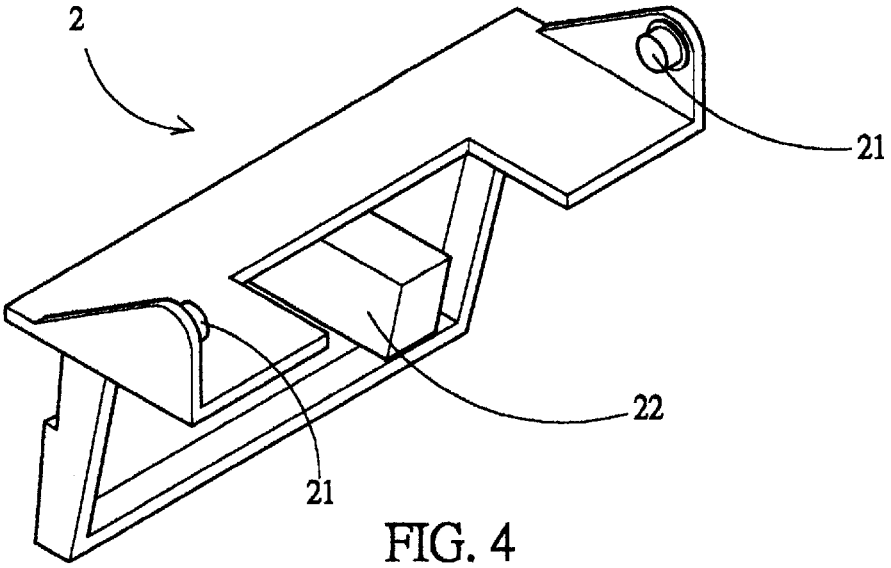
FIG. 4 is a perspective view of the handle according to the present invention.
Figure 5:
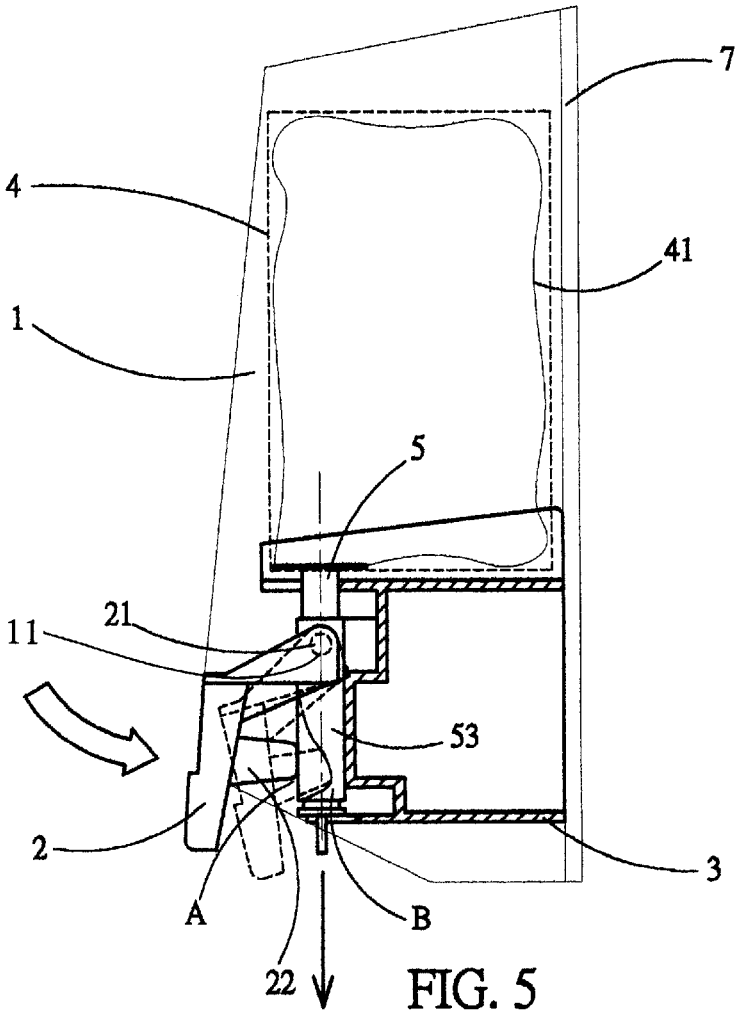
FIG. 5 is a schematic drawing showing the operation of the handle according to the present invention.
Figure 6C:
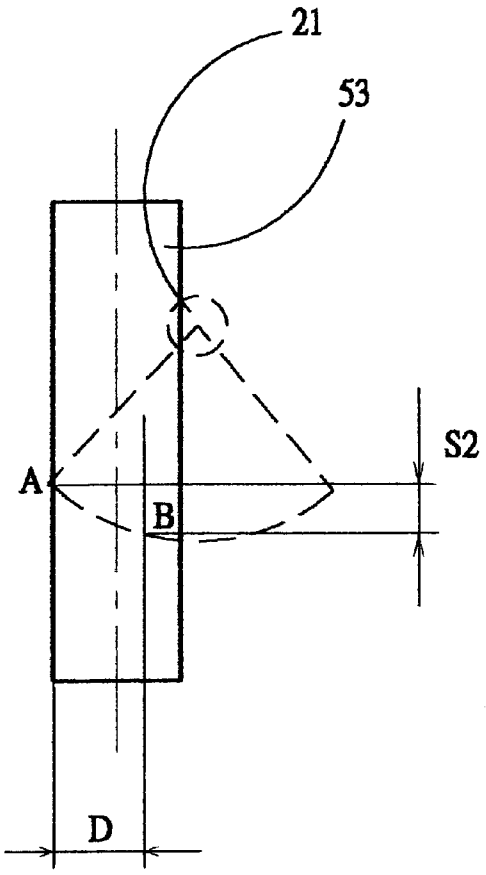
FIG. 6 is a schematic drawing explaining the effect of the center of rotation of the handle in different positions.
Figure 6B:
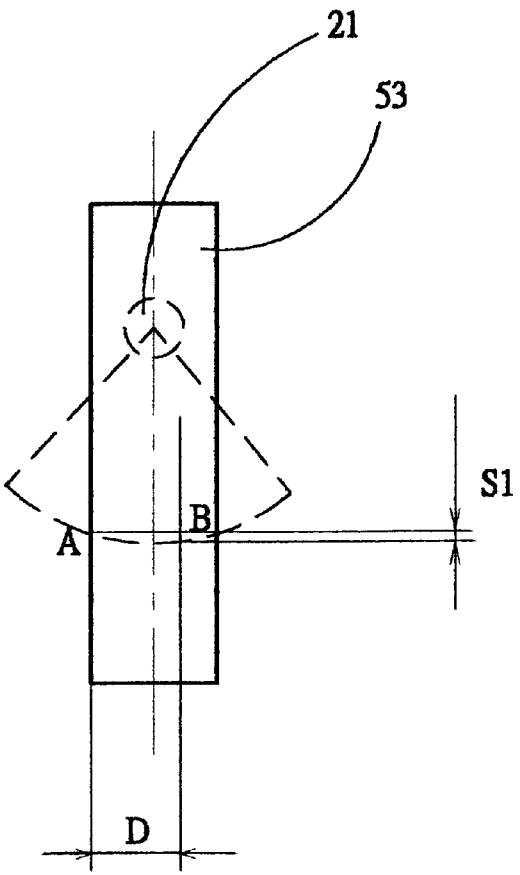
Figure 6A:
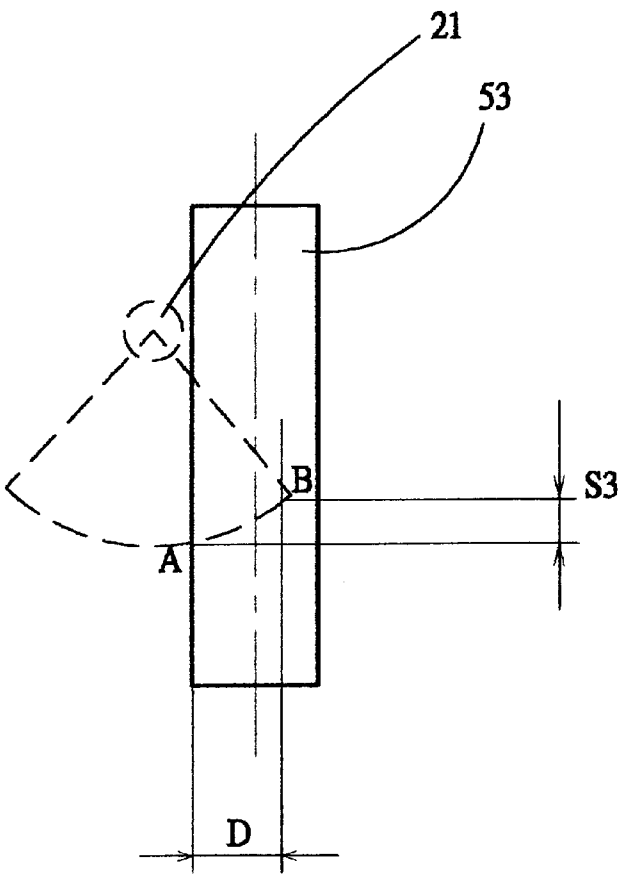

Referring to FIGS. 4 and 5, the handle 2 comprises two pivot pins 21 bilaterally disposed at the top side and pivoted to respective pivot holes 11 at the cover shell 1, a squeeze rod 22 raised from the back side thereof for squeezing the flexible nozzle tube 53 of the dispensing nozzle 5. The axis which passes through the pivot holes 11 and the pivot pins 21 intersects with the longitudinal central axis of the flexible nozzle tube 53. When the handle 2 is depressed. the squeeze rod 22 is moved with the handle 2 to touch the flexible nozzle tube 53 at location A, and then to squeeze the flexible nozzle tube 53, causing the flexible nozzle tube 53 to be deformed and a metered amount of the contained liquid soap to be squeezed out of the nozzle tip of the flexible nozzle tube 53. When the flexible nozzle tube 53 is squeezed and deformed, the squeeze rod 22 is moved from locating A to location B. The compressive stroke D is fixed. When the contact point is moved from location A to locating B, the projected distance of the displacement of the contact point from location A to location B in axial direction is S1 if the center of rotation of the handle 2 is set at the longitudinal central axis of the flexible nozzle tube 53 (see the drawing in the middle), the projected distance of the displacement of the contact point from location A to location B in axial direction is S2 if the center of rotation of the handle 2 is set biased to the right side and spaced rightwards from the longitudinal central axis of the flexible nozzle tube 53 at a distance (see the right-sided drawing), the projected distance of the displacement of the contact point from location A to location B in axial direction is S3 if the center of rotation of the handle 2 is set biased to the left side and spaced leftwards from the longitudinal central axis of the flexible nozzle tube 53 at a distance (see the left-sided drawing). As indicated, the distance of S1 is smaller than S2 and S3. i.e. the displacement of the contact point between the squeeze rod 22 and the flexible nozzle tube 53 is minimized when the axis which passes through the pivot holes 11 of the cover shell 1 and the pivot pins 21 of the handle 2 is designed intersected with the longitudinal central axis of the flexible nozzle tube 53. Because the displacement amount is minimized, less friction is produced when the squeeze rod 22 is forced to squeeze the flexible nozzle tube 53, and the service life of the flexible nozzle tube 53 can be prolonged.

While only one embodiment of the present invention has been shown and described, it will be understood that various modifications and changes could be made thereunto without departing from the spirit and scope of the invention disclosed.

What the invention claimed is:

1. A liquid soap dispenser comprising:

a housing, said housing comprising a base frame and a cover shell pivoted to said base frame;

a locking frame coupled to said base frame and moved between a first position where said cover shell is locked, and a second position where said cover shell is unlocked and allowed to be opened from said base frame;

a container holder mounted inside said housing;

a liquid soap container carried on said container holder inside said housing, said liquid soap container holding a liquid soap;

a dispensing nozzle connected to said liquid soap container pivoted to said base frame and retained to a front side of said container holder to suck in the liquid soap from said liquid soap container and to let an amount of the liquid soap to be dispensed when squeezed, said dispensing nozzle comprising a flexible nozzle tube connected to said liquid soap container at a bottom side, and a nozzle tip extended from one end of said flexible nozzle tube remote from said liquid soap container out of said housing; and a handle controlled to squeeze the liquid soap out of said flexible nozzle tube through said nozzle tip, said handle having two pivot pins respectively pivoted to respective pivot holes on said cover shell and a squeeze rod moved with said handle to squeeze said flexible nozzle tube;

wherein:

said base frame comprises two longitudinal flanges raised from an inside wall thereof and arranged in parallel, a plurality of spring strips respectively raised from the inside wall between said longitudinal flanges, and two rows of vertically spaced hooks bilaterally raised from the inside wall and separated by said longitudinal flanges;

said container holder is supported on the longitudinal flanges of said base frame and pressed against the spring strips of said base frame, having symmetrical pairs of hooks hooked up with the hooks of said base frame;

the axis which passes through the pivot holes on said cover shell and the pivot pins of said handle intersects with the longitudinal central axis of said flexible nozzle tube.

* * * * *